US007017406B1

(12) United States Patent
Cressman

(10) Patent No.: US 7,017,406 B1
(45) Date of Patent: Mar. 28, 2006

(54) PUMP TESTING SYSTEM

(76) Inventor: Paul D. Cressman, 2712 S. River Bluff Rd., Sioux Falls, SD (US) 57110

( * ) Notice: Subject to any disclaimer, the term of this patent is extended or adjusted under 35 U.S.C. 154(b) by 392 days.

(21) Appl. No.: 10/413,860

(22) Filed: Apr. 14, 2003

(51) Int. Cl.
*G01M 19/00* (2006.01)

(52) U.S. Cl. ..... 73/168

(58) Field of Classification Search ..... 73/168, 73/198
See application file for complete search history.

(56) References Cited

U.S. PATENT DOCUMENTS

| | | | | | |
|---|---|---|---|---|---|
| 1,774,723 | A | * | 9/1930 | Packard | 73/168 |
| 2,073,243 | A | * | 3/1937 | Liddell et al. | 73/113 |
| 2,098,677 | A | * | 11/1937 | Saballus et al. | 73/118.1 |
| 2,612,777 | A | * | 10/1952 | Greer | 73/168 |
| 2,795,950 | A | * | 6/1957 | Liddell | 73/1.36 |
| 3,225,591 | A | * | 12/1965 | Orkney, Jr. et al | 73/112 |
| 3,230,761 | A | * | 1/1966 | Sanders | 73/119 A |
| 3,296,854 | A | * | 1/1967 | Morgan | 73/118.1 |
| 3,374,667 | A | * | 3/1968 | Mayer | 73/119 A |
| 3,680,371 | A | * | 8/1972 | Marcio et al. | 73/119 A |
| 4,028,174 | A | | 6/1977 | Myren | |
| 4,114,426 | A | * | 9/1978 | McLean | 73/40.5 R |
| 4,206,634 | A | * | 6/1980 | Taylor et al. | 73/119 A |
| 4,333,338 | A | * | 6/1982 | Patey et al. | 73/119 A |
| 4,498,347 | A | | 2/1985 | Grantham et al. | |
| 4,638,233 | A | * | 1/1987 | Erdman | 318/644 |
| 4,696,194 | A | | 9/1987 | Taylor | |
| 4,714,522 | A | | 12/1987 | Holik | |
| 4,960,152 | A | * | 10/1990 | Hubert et al. | 137/559 |
| 5,082,013 | A | | 1/1992 | Scheib | |
| 5,804,716 | A | | 9/1998 | McGuire et al. | |
| 5,919,289 | A | | 7/1999 | Misawa et al. | |
| 6,096,120 | A | | 8/2000 | Erlund et al. | |
| 6,386,049 | B1 | | 5/2002 | Schrumm | |
| 6,416,632 | B1 | | 7/2002 | Kirjasniemi et al. | |
| 6,807,855 | B1 | * | 10/2004 | Stroup | 73/768 |

* cited by examiner

*Primary Examiner*—Hezron Williams
*Assistant Examiner*—John Fitzgerald
(74) *Attorney, Agent, or Firm*—Woods Fuller Shultz & Smith PC

(57) ABSTRACT

A pump testing apparatus is disclosed for testing output characteristics of a fluid flow exiting a pump. The apparatus includes a flow testing structure for testing characteristics of the fluid flow, a first chamber having an interior for receiving a fluid flow exiting the flow testing structure, and a second chamber having an interior for receiving fluid flow from the first chamber. The second chamber has an entrance opening for receiving fluid flow into the interior of the second chamber and a discharge opening for discharging fluid flow from the interior of the second chamber, the second chamber defining a convoluted path for the fluid flow between the entrance opening and the discharge opening. The apparatus also includes structures located in at least one of the first chamber and the second chamber for reducing a velocity of the fluid flow.

19 Claims, 9 Drawing Sheets

PUMP TESTING SYSTEM

BACKGROUND OF THE INVENTION

1. Field of the Invention

The present invention relates to pump testing systems and more particularly pertains to a new compact and portable pump testing system for permitting testing of pumps, such as those on fire fighting equipment, at virtually any location as the portable nature of the system permits simple movement of the system and the compactness of the system permits it to be set up in almost any location, even inside of a building.

2. Description of the Prior Art

Pumps employed on fire fighting equipment, such as fire trucks, are typically periodically tested to determine if the pumps are able to perform up to design capacity for meeting various certification requirements or for simply providing piece of mind that the pumps will perform as expected when they are needed. It is desirable to conduct the periodic testing under conditions as close as possible to the conditions employed by the original certifying entities (such as Underwriters Laboratories) to determine the conformance of equipment with the various standards (such as NFPA 1901) established by standards-setting organizations (such as National Fire Protection Association (NFPA)). If these conditions are substantially duplicated, true conformance with the applicable standards and rules may be ascertained. The battery of tests may be performed approximately every year for each pumping apparatus owned by a fire fighting entity.

Sometimes such testing will be performed using a hydrant to supply the water necessary for the tests, but if the fluid cannot be recaptured it is wasted. At flow rates of 1000 gallons per minute or more, a significant amount of water can be used that can draw down the water level in a community water storage facility very quickly. It is therefore desirable to use a recirculating flow of fluid that is drawn from a reservoir and discharged back to the reservoir. In such a system, the fluid used in the test is drawn from the reservoir by an intake conduit and the fluid is then returned to the reservoir after being pumped through the pump and any testing apparatus.

While the use of a reservoir is probably the most efficient manner for testing the pumping apparatus, it is not without drawbacks that can affect the performance of the pump being tested and thus throw off the results of the testing. While the most useful reservoir is typically the most compact and portable reservoir (such as a foldable reservoir), the employment of relatively small reservoir sizes can present testing problems.

Probably the most significant problem encountered when using a relatively small, portable reservoir results from the entrainment of air bubbles in the fluid as the fluid is discharged back into the reservoir after flowing through the pump. If the air bubbles are drawn into the intake conduit and introduced into the pump, the ability of the pump to pump the fluid can be significantly degraded. Since the flow rate and velocity of the fluid discharged into the reservoir from the pump can be substantial (up to and exceeding 1000 gallons per minute per pump), the fluid can pick up a significant quantity of air before entering, or upon entering, the reservoir. Any air bubbles entrained in the fluid must be permitted to escape from the fluid before the fluid is drawn into the intake conduit. Thus, the intake of the intake conduit must be sufficiently separated from the point of the fluid reentry into the reservoir to allow this escape. Air bubbles present an even bigger problem if two pumps are being simultaneously tested. As a result, the more air that is being entrained in the fluid before reentering the reservoir, the greater the distance that needs to be maintained between the point of fluid entry into the reservoir and the point where the intake end of the intake conduit is located to allow the air bubbles to escape. The size of the reservoir may need to be increased to provide a sufficient separation between these points, and may require the use of more fluid in the reservoir so that fluid with air bubbles is not as quickly redrawn into the intake end of the intake conduit.

Another challenge resulting from the use of a relatively smaller reservoir is the inducement of movement of the fluid in the reservoir. If the fluid enters the reservoir at a relatively high velocity, then the fluid in the reservoir will be induced to move about the reservoir (such as in a swirling movement) that may make it more difficult for the pump to pull the fluid into the intake of the intake conduit, which can also negatively affect the performance of the pump being tested. Excessive induced fluid movement may also cause any air bubbles in the fluid to move more quickly toward and into the intake end of the intake conduit.

Pump flow testing apparatus have been devised, and one example is disclosed in U.S. Pat. No. 6,386,049 to Schrumm. The Schrumm pump flow test system employs a manifold assembly that needs to be anchored in place using the weight of a vehicle to counter the recoil or reaction force of the water leaving the manifold assembly. Also, rather than using a conventional foldable reservoir, the Schrumm system uses a specialized or modified reservoir structure in which a hole is formed in the side wall of the reservoir structure to accept a tube portion of the manifold assembly that carries the water flow from the pump. A seal thus needs to be formed and maintained between the tube and the hole in the side wall of the reservoir structure to prevent water leakage. Thus the Schrumm system may be vulnerable to leakage if the seal is not properly formed upon each set up of the system, and may especially become a problem after the system has been repeatedly set up and knocked down.

Further, the Schrumm system is designed to test the flow characteristics of the combined output of one or more of the pumps of a vehicle, or each of the pumps one at a time, but is not able to test more than one pump individually and simultaneously if desired. Thus, if more than one pump needs to be tested individually with the Schrumm system, the pumps have to be tested consecutively to get the desired individual results for the pumps.

Another concern is the need to test the pump or pumps of the fie fighting apparatus while avoiding taking the apparatus on which the pump is mounted out of service for long periods of time, since the pump may be mounted on the only fire fighting apparatus of its type possessed by the fire fighting entity and may unexpectedly be needed during the course of testing for fighting a fire.

Therefore, there is a need for a system that permits the use of relatively small reservoir sizes for permitting maximum portability and ease of set up and knock down, while minimizing any negative effects on pump performance by the use of the small reservoir.

SUMMARY OF THE INVENTION

In view of the foregoing disadvantages inherent in the known types of pump testing systems now present in the prior art, the present invention provides a new pump testing system construction wherein the same can be utilized for permitting testing of pumps, such as those on fire fighting equipment, at virtually any location as the portable nature of the system permits simple movement of the system and the compactness of the system permits it to be set up in almost any location, even inside of a building.

In general, a pump testing apparatus is disclosed for testing output characteristics of a fluid flow exiting a pump. The apparatus includes a flow testing structure for testing characteristics of the fluid flow, a first chamber having an interior for receiving a fluid flow exiting the flow testing structure, and a second chamber having an interior for receiving fluid flow from the first chamber. The second chamber has an entrance opening for receiving fluid flow into the interior of the second chamber and a discharge opening for discharging fluid flow from the interior of the second chamber, the second chamber defining a convoluted path for the fluid flow between the entrance opening and the discharge opening. The apparatus also includes structures located in at least one of the first chamber and the second chamber for reducing a velocity of the fluid flow.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage that the present invention provides is the ability to perform onsite testing of a pump of fire fighting equipment. A pair of pumps may be tested individually and simultaneously using a relatively small quantity of fluid held in a relatively small reservoir without degrading the performance of the pumps.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

With reference now to the drawings, and in particular to FIGS. 1 through 9 thereof, a new pump testing system embodying the principles and concepts of the present invention will be described.

The pump testing apparatus 10 of the present invention is contemplated as a part of a system for testing the output characteristics of the flow of fluid from a pump 1, and is especially suitable for testing the performance characteristics of a pump on a piece of fire fighting equipment such as a fire fighting vehicle or pumper fire truck during periodic certification and re-certification procedures.

Figure 1:
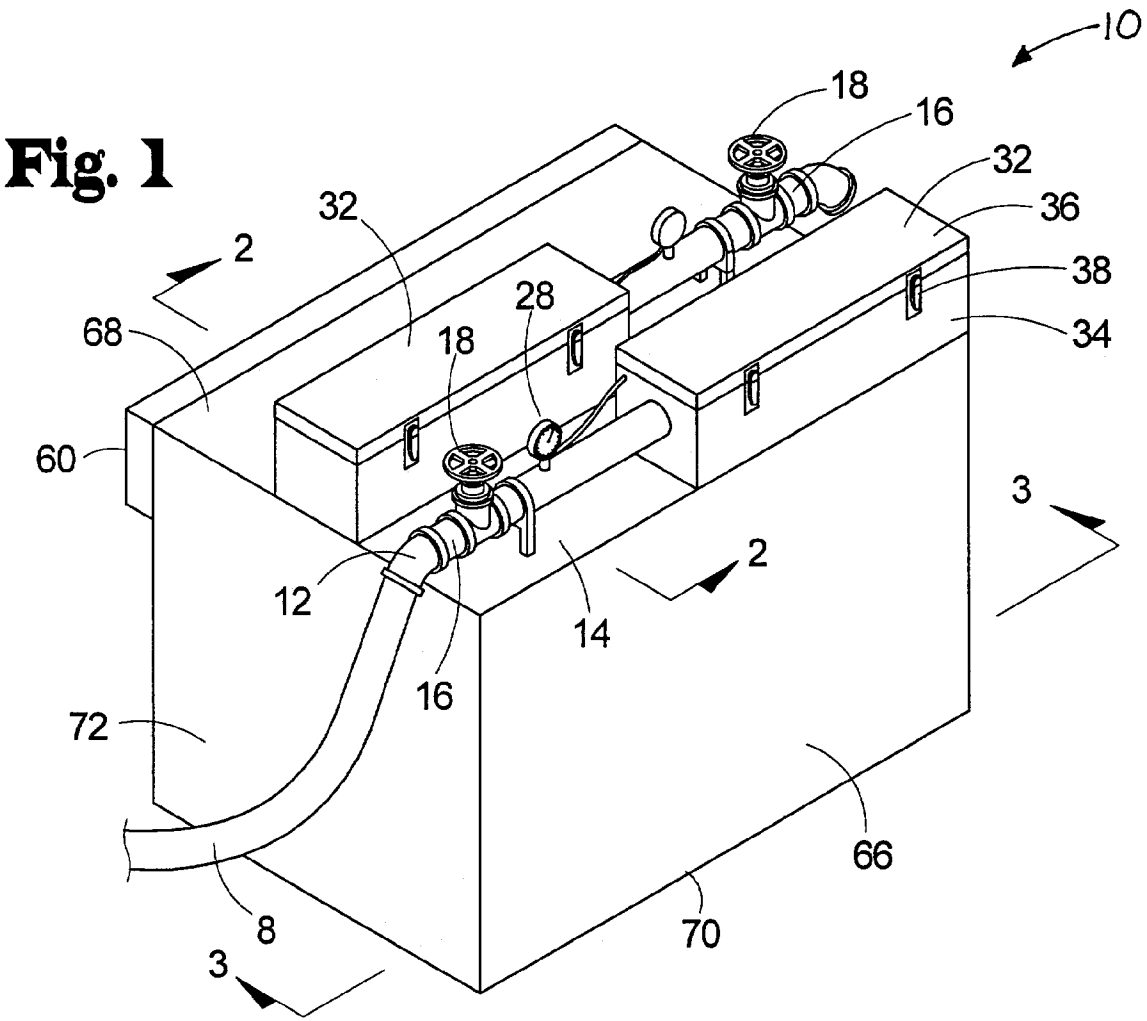
FIG. 1 is a schematic perspective view of a new pump testing system according to the present invention.
Figure 2:
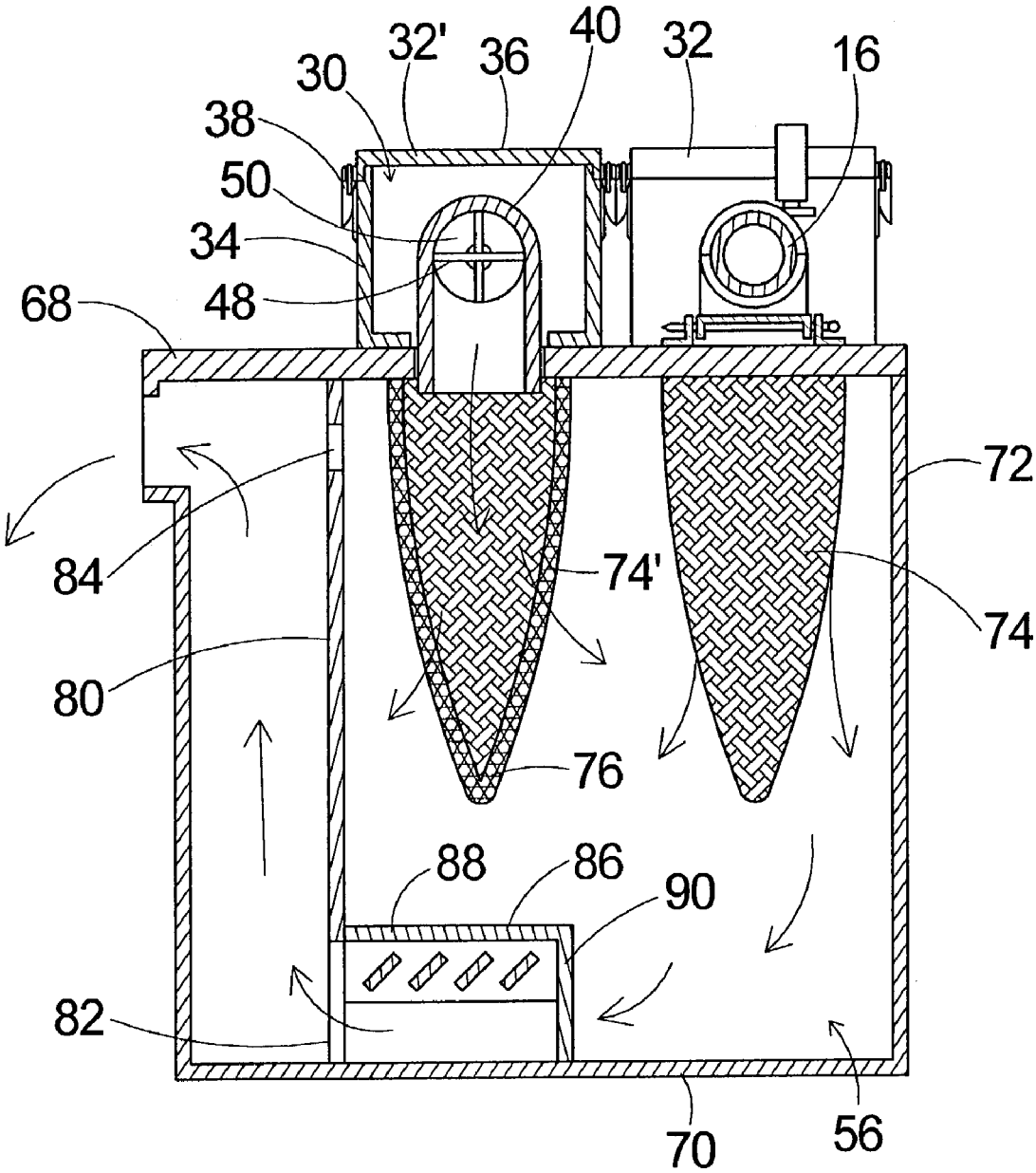
FIG. 2 is a schematic sectional view of the present invention taken alone line 2—2 of FIG. 1.
Figure 3:
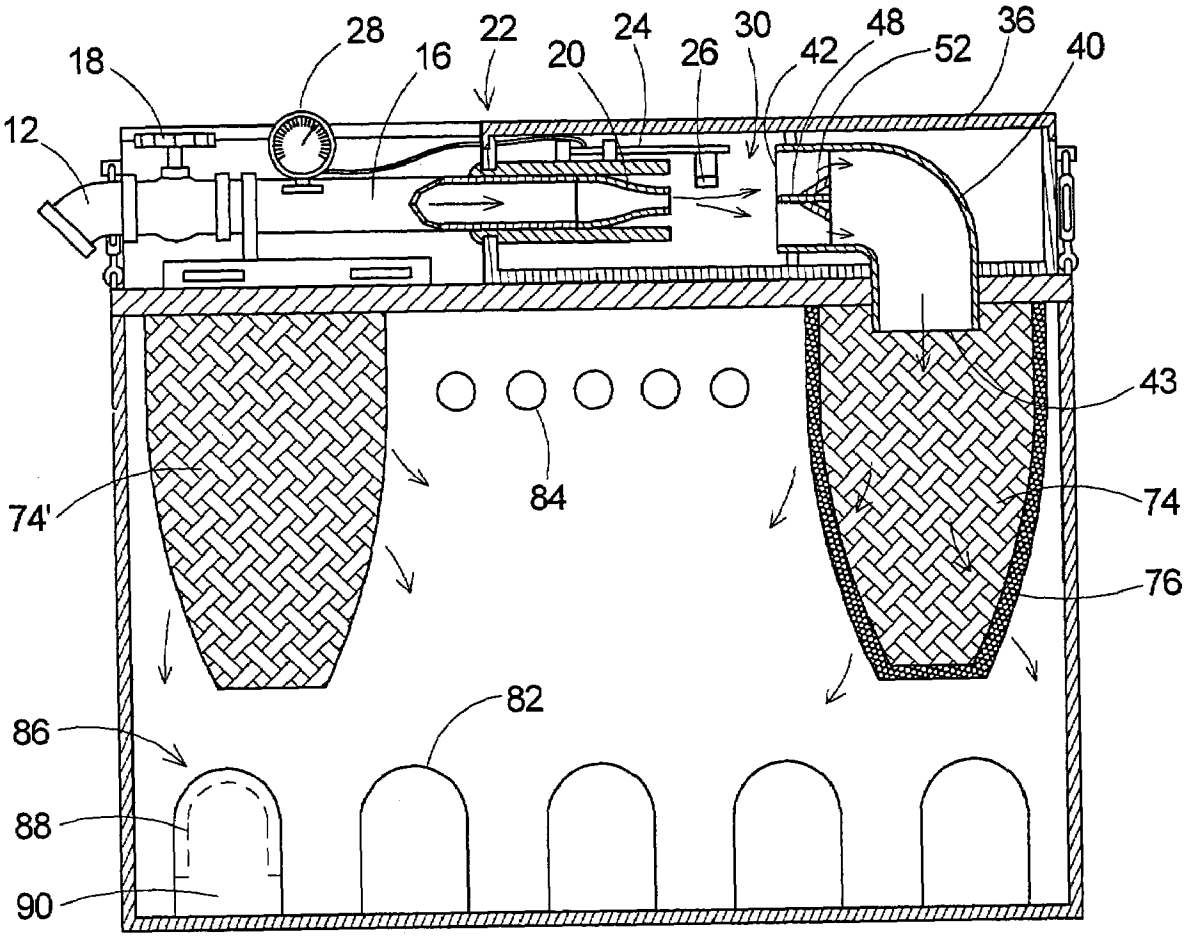
FIG. 3 is a schematic sectional view of the present invention taken along line 3—3 of FIG. 1.
Figure 4:
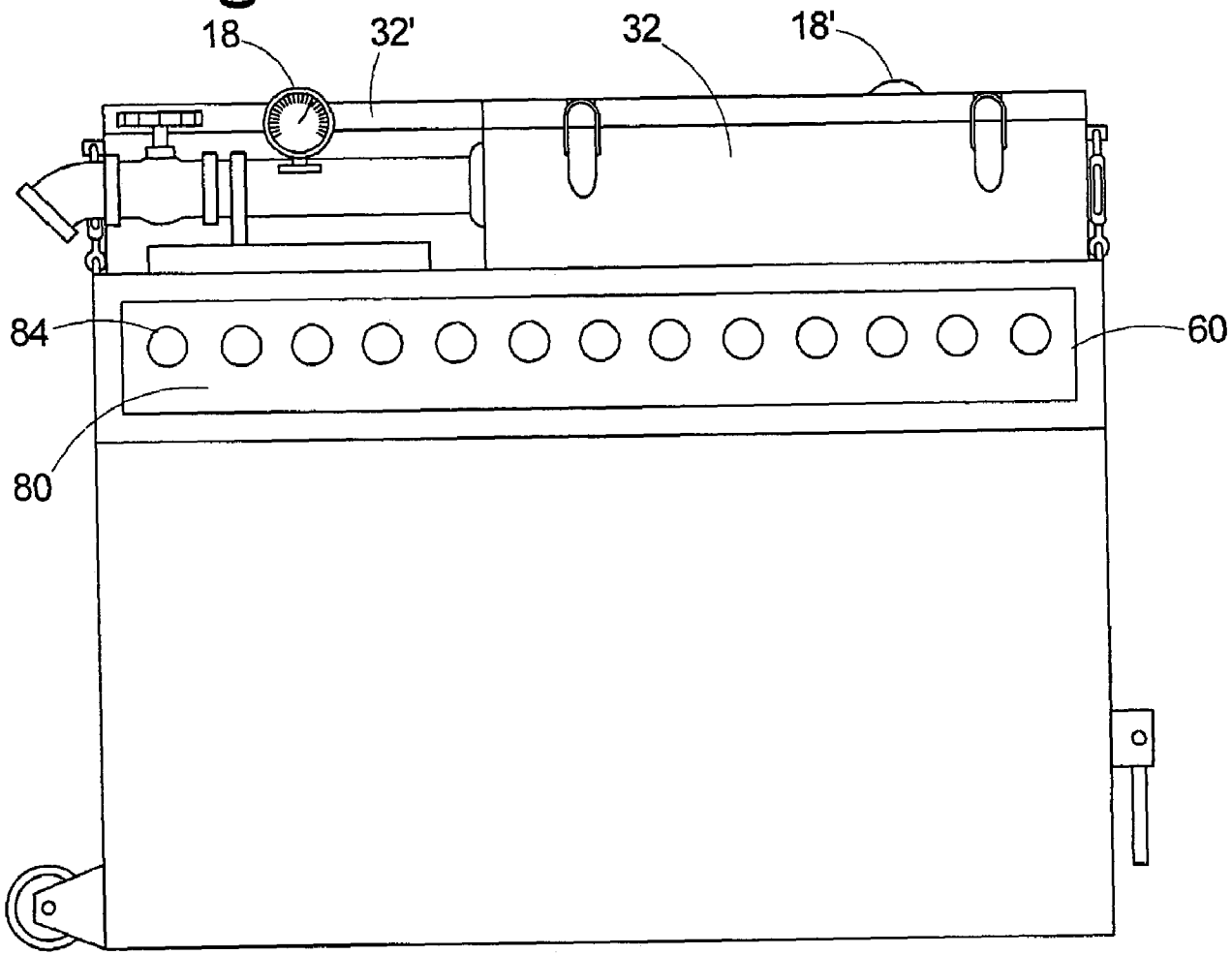
FIG. 4 is a schematic side view of the present invention particularly illustrating the discharge opening.
Figure 5:
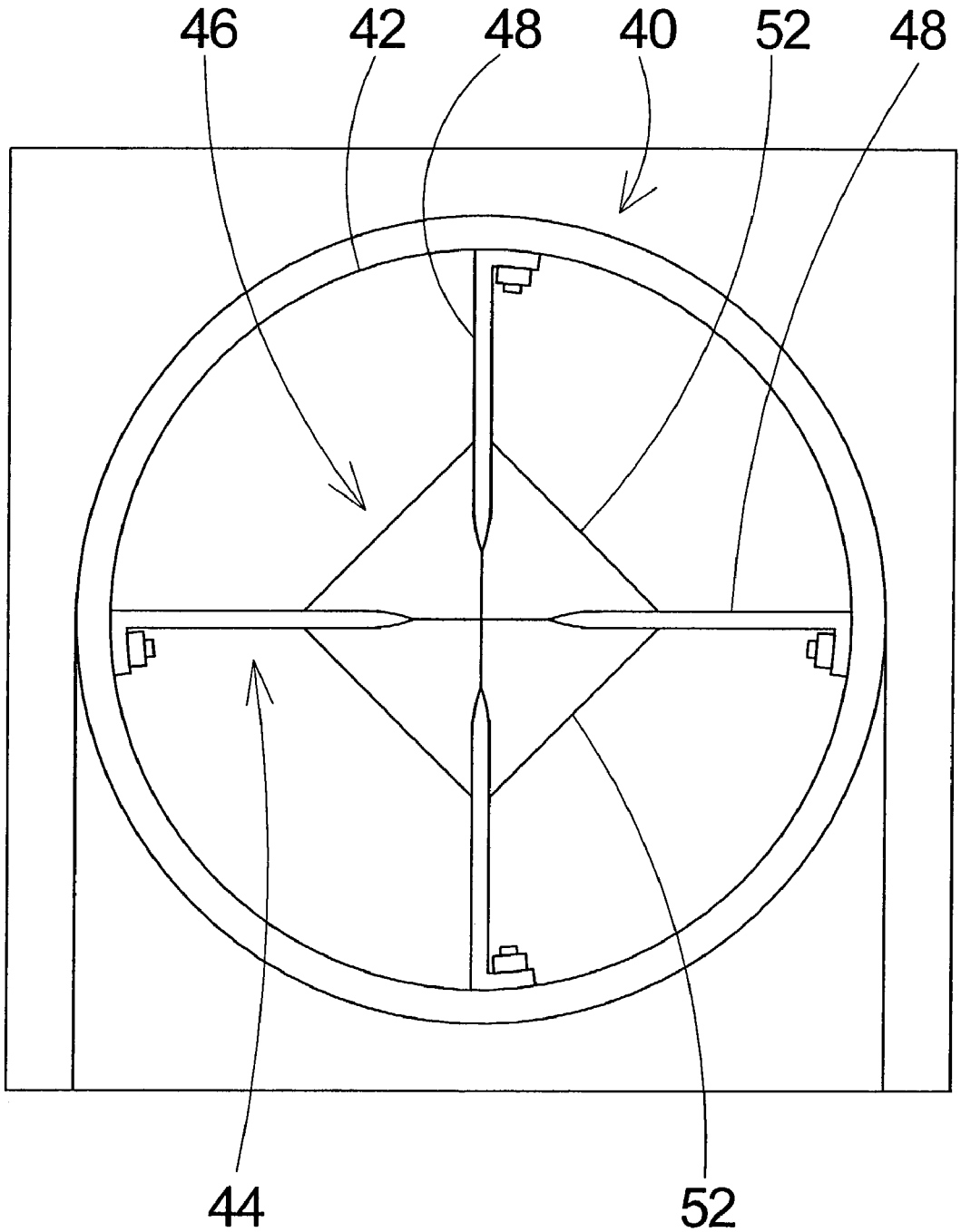
FIG. 5 is a schematic end view of one embodiment of the redirecting means, dividing means, and diverting means of the present invention.
Figure 6:
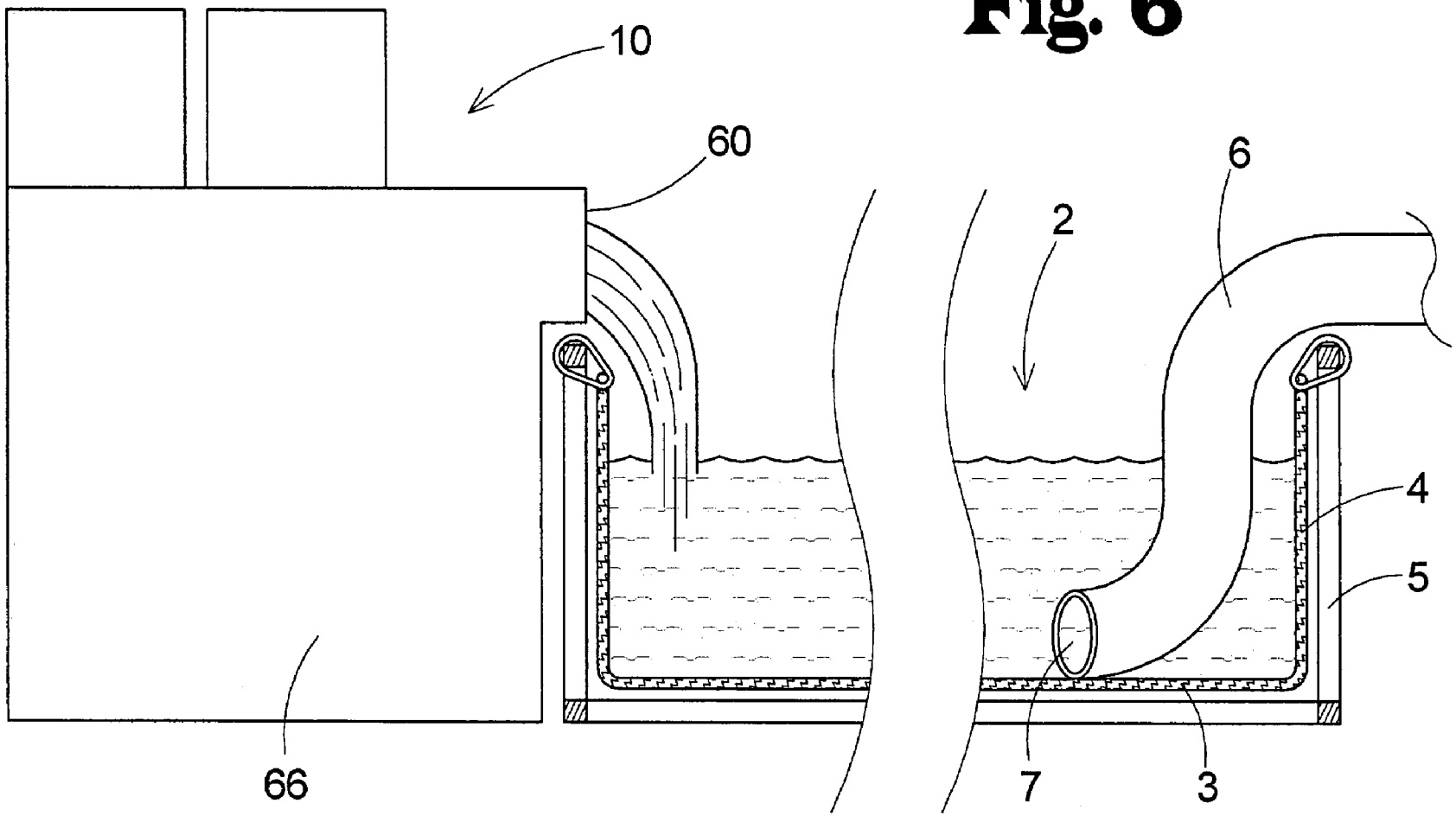
FIG. 6 is a schematic side view of the present invention in relation to a reservoir holding the fluid and an intake conduit in communication with the fluid in the reservoir.
Figure 7:
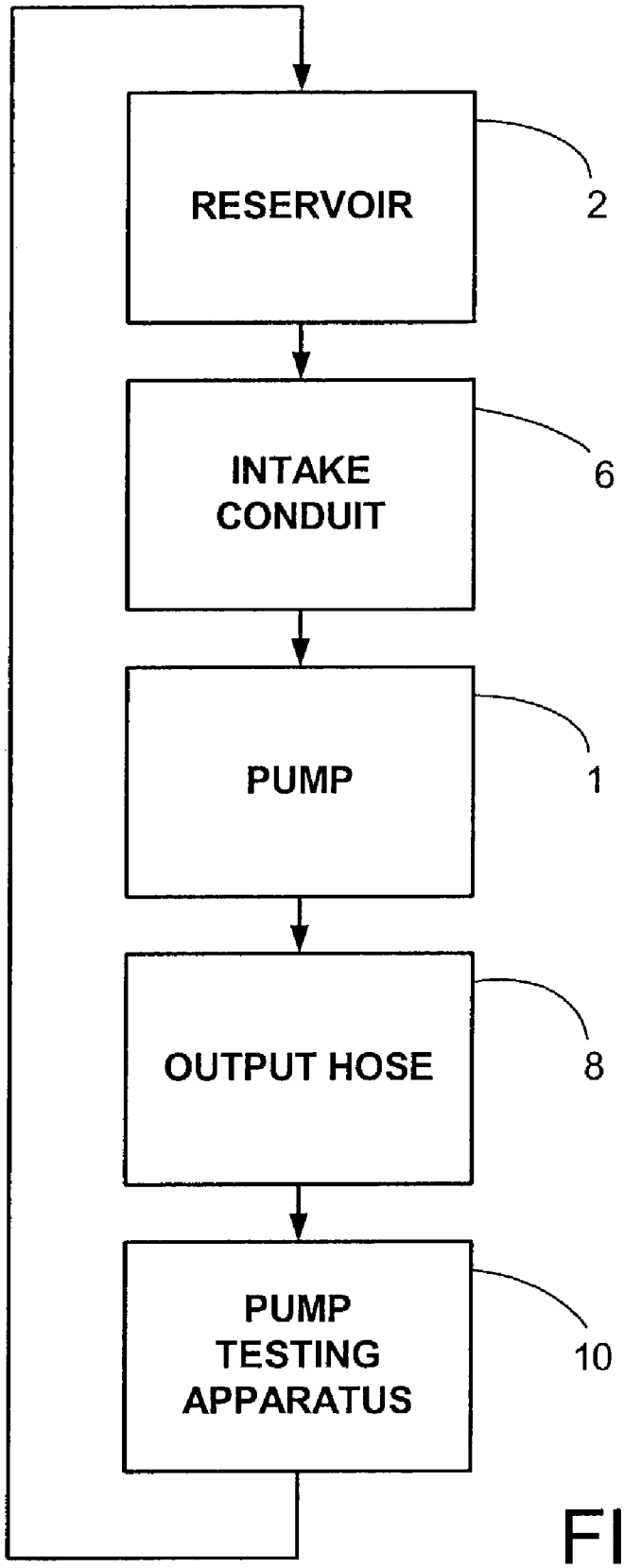
FIG. 7 is a schematic diagrammatic representation of fluid movement during operation of the present invention.
Figure 8:
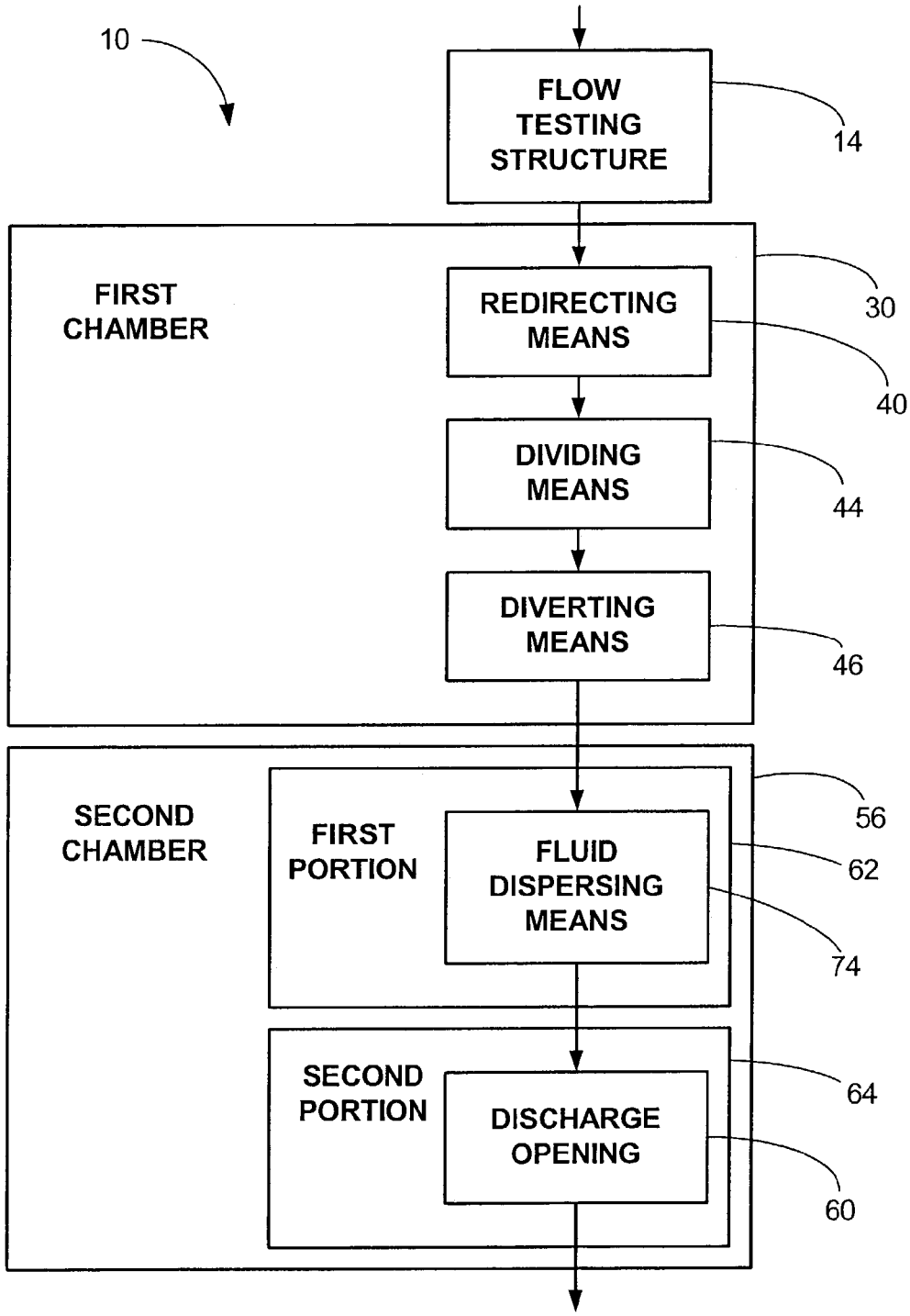
FIG. 8 is a schematic diagrammatic representation of fluid movement through the pump testing apparatus during operation of the present invention.
Figure 9:
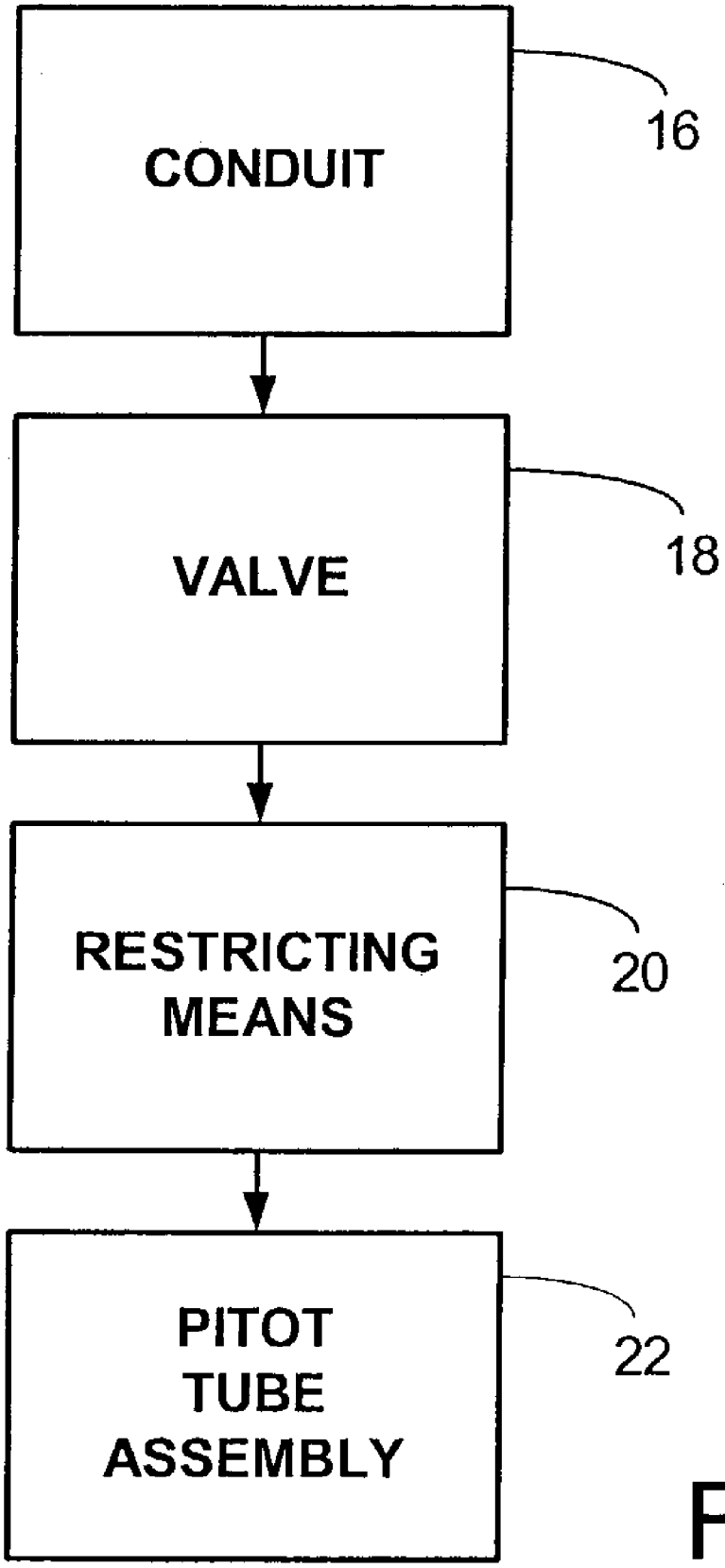
FIG. 9 is a schematic diagrammatic representation of fluid movement through the flow testing structure during operation of the present invention.

The system in its most encompassing aspect may include a reservoir 2 for holding a quantity of fluid to be used in the testing of the pump or pumps (see FIG. 6). Typically, the reservoir 2 will have a bottom wall portion 3 and a perimeter side wall portion 4 that extends upwardly from the bottom wall portion to form an interior of the reservoir for receiving the fluid. In one highly portable embodiment of the reservoir 2, the bottom wall portion 3 and the side wall portion 4 are formed of a flexible material that may be folded together into a compact configuration between uses. The reservoir 2 may include a frame 5 for supporting flexible bottom 3 and perimeter side wall 2 portions, and the frame may be easily assembled and disassembled for easy portability.

An intake conduit 6 may also be utilized for moving fluid from the reservoir 2 to the pump 1 or pumps to be tested so that a circulation of the fluid flow is developed. The intake conduit 6 may have an intake end 7 that is positionable in the interior of the reservoir 2 for drawing fluid from the interior of the reservoir (see FIG. 6). The intake conduit 6 may have an outflow end (not shown) for connecting to an input of the pump 1 to be tested.

The invention includes a pump testing apparatus 10 for connecting to one or more pumps for testing the output characteristics and performance of the pumps individually and simultaneously, if desired. The pump testing apparatus 10 may include means for coupling to an output hose 8 or other conduit carrying the fluid flow from the pump to be tested. The coupling means may comprise, for example, a standard fire hose coupler 12 for permitting quick and easy coupling to the output fire hose 9 connected to the pump 1.

The pump testing apparatus 10 may also include a flow testing structure 14 for testing characteristics of the fluid flow entering the coupler 12. In greater detail, the flow testing structure 14 may include a conduit 16 for receiving the fluid flow to be tested. The conduit 16 is connected to and in communication with the coupler. In one embodiment of the invention, the conduit 16 has an internal diameter of approximately 2.5 inches (approximately 6.3 centimeters), although other diameters may be employed.

The flow testing structure 14 may also include a valve 18 for controlling the rate of the volume of the fluid flow through the conduit 16 of the flow testing structure. The valve 18 may be adjusted between tests for changing the volumetric flow rate of the fluid through the conduit. This is especially useful when the testing must be conducted at particular flow rates, such as, for example, 100% of the rated flow capacity of the pump, 75% of the rated flow capacity of the pump, and 50% of the rated flow capacity of the pump. One highly suitable type of valve is a gate type valve, which can easily provide relatively small incremental changes in the flow rate through the valve body. The flow testing structure 14 may also include means for restricting the fluid flow according to a corresponding nozzle size or diameter. The restricting means may have a lumen that is positionable in communication with the conduit 16 for receiving the fluid flow. In one embodiment of the invention, the restricting means comprises a nozzle structure 20 having a lumen with a diameter corresponding to an internal diameter of a fire nozzle. A plurality of the nozzle structures may be provided for testing the pump with various combinations of, for example, nozzle diameters and flow rates.

The flow testing structure 14 of the apparatus 10 of the invention may also include a pitot tube assembly 22 positioned on the conduit for measuring pressure characteristics of the fluid flow through the conduit. Illustratively, the pitot tube assembly 22 includes an arm 24 that supports the end 26 of a pitot tube at a distance from the end of the conduit and the nozzle structure so that the end 26 of the pitot tube is positioned in the fluid flow exiting the nozzle structure 20. The pitot tube assembly may also include a pressure gauge 28 which is in fluid communication with the end 26 of the tube opposite the end of the tube positioned in the fluid flow.

The apparatus 10 of the invention may also include a first chamber 30 that has an interior for receiving a fluid flow exiting the flow testing structure 14. The first chamber 30 is preferably substantially sealed against movement of air from an exterior of the first chamber to the interior of the chamber for the purpose of minimizing the drawing of air into the fluid flow in the first chamber, which could entrain air bubbles in the fluid.

A first housing 32 may be provided for defining the first chamber 30. The first housing 32 may include a base portion 34 that has an upper opening. The first housing 32 may also include a lid portion 36 for removably covering the upper opening of the base portion. The lid portion 36 is most preferably mountable on the base portion 34 in a manner that is suitable for creating a substantially air tight closure for resisting air intrusion into the fluid flow in the interior of the first chamber. In one embodiment of the invention, the air tight closure between the lid portion 36 and the base portion 34 is formed by a gasket material situated therebetween, and a means for compressing the gasket material such as, for example, a plurality of clamping structures 38 that bridge between the lid portion and the base portion.

The apparatus 10 may further include means for redirecting the fluid flow in the interior of the first chamber. The redirecting means may be employed to redirect or turn the direction of the fluid flow at least 90 degrees between a direction of initial fluid flow and a direction of redirected fluid flow. In one embodiment of the invention, the redirecting means is embodied as a redirecting conduit 40, such as, for example, a 90-degree pipe elbow. The redirecting conduit 40 may have an entrance 42 that is located in the interior of the first chamber 30, and may have an exit 43 that is located outside of the first chamber, such as in the interior of the second chamber 56 discussed in greater detail below. In one embodiment of the invention, the entrance 42 of the redirecting conduit 40 is substantially horizontally oriented for receiving a substantially horizontal fluid flow, and the exit 43 of the redirecting conduit is substantially vertically oriented for causing the fluid to flow in a substantially vertical, and downward, direction.

The apparatus 10 may also include means 44 for cutting or dividing the fluid flow in the first chamber into at least two substantially separate fluid flows for removing energy from the fluid flow and also to slow the velocity of the fluid flow. The dividing means 44 may also include diverting means 46 for diverting the separate fluid flows away from each other in generally opposite directions. In one embodiment of the invention, the dividing means 44 may be located on the redirecting conduit 40 for dividing the fluid flow just prior to the fluid flow being redirected, or as the fluid flow is being redirected, by the redirecting conduit. Significantly, the multiple fluid flows may be permitted to rejoin each other into a single fluid flow as the fluid flow leaves the first chamber.

In one embodiment of the invention, the dividing means 44 may be embodied by a plurality of dividing blades 48 mounted on and positioned in the redirecting conduit 40. Illustratively, the plurality of blades 48 may comprise two intersecting blades 48 that cross and divide the lumen of the redirecting conduit 40 into four segments 50 to thereby divide the fluid flow into four components. The length of the segments 50 in the direction of the water flow may be relatively short as compared to the length of the lumen of the redirecting conduit, and may permit the fluid flows to rejoin each other even before the conduit redirects the fluid flow. In one embodiment of the invention, the diverting means 46 is embodied by a plurality of deflectors 52 that are mounted on the plurality of blades 48 and that have a surface that is skewed with respect to the axis of flow of the fluid, so that the fluid contacting the blades is deflected and the fluid moves radially outwardly from the axis of flow. In the illustrative embodiment, the deflected fluid is directed toward and against the interior surfaces of the redirecting conduit 40, which then directs all of the fluid flows in generally the same direction.

The apparatus 10 of the invention may further include a second chamber 56 that has an interior for receiving fluid flow leaving the first chamber. The second chamber 56 may have an entrance opening 58 for receiving fluid flow into the interior of the second chamber and a discharge opening 60 for discharging fluid flow from the interior of the second chamber. In one embodiment, the second chamber 56 defines a convoluted path for the fluid flow between the entrance opening 58 and the discharge opening 60 for removing energy from the fluid flow and ultimately slowing the fluid flow through the second chamber. The convoluted path may include at least one 180 degree change of direction for the fluid flow in the second chamber, and may further include a 90 degree change of direction for the fluid flow as the fluid exits through the discharge opening 60.

In one embodiment of the invention, the second chamber 56 includes first 62 and second 64 portions. The first portion 62 of the second chamber is in communication with the entrance opening 58 of the second chamber for initially receiving the fluid flow entering the second chamber, such as from the first chamber 30. The second portion 64 of the second chamber is in communication with the discharge opening 60, and may receive the fluid flow from the first portion 62 of the second chamber and then discharge the fluid flow through the discharge opening.

A second housing 66 may be employed to define the second chamber 56. The second housing may be positioned below the first housing 32 for receiving the fluid flow from the first chamber 30. The second housing 66 may illustratively have an upper wall 68, a lower wall 70, and a perimeter wall 72 that extends between the upper and lower walls.

The invention may further include a fluid dispersing structure 74 for removing further energy from the fluid flow to slow the velocity of the fluid. The fluid dispersing structure 74 may be located in the interior of the second chamber 56 and may be positioned in a manner that permits the structure to receive the fluid flow entering the second chamber and then to disperse the fluid flow about the interior of the second chamber. The fluid dispersing structure 74 may intercept the fluid flow and cause portions of the fluid flow to be dispersed by the deflection of portions of the fluid from the direction of flow. The fluid dispersing structure 74 may be located in the first portion 62 of the second chamber 56. In one embodiment of the invention, the fluid dispersing structure 74 has a generally conical shape that is inverted in orientation. The fluid dispersing structure 74 may include a substantially conical wall 76 with a plurality of perforations therein for permitting the fluid to flow through the perforations. Significantly, the axis of the perforations through the wall 76 is not parallel to the direction of fluid flow into the second chamber, but is skewed to cause the fluid to be deflected from its initial path. The generally conical perforated wall 76 may be elongated in a first transverse direction and collapsed in a second transverse direction that is oriented substantially perpendicular to the first transverse direction so that a transverse cross section of the wall 76 is substantially oval. This feature is particularly beneficial for making the fluid dispersing structure 74 more compact in the width direction of the second housing 66. The generally conical wall 76 of the fluid dispersing structure 74 may be formed from a mesh or screen like material, and in an illustrative embodiment of the invention is formed of the material commonly known as expanded metal material.

In one preferred embodiment of the invention, the apparatus 10 includes means for simultaneously and independently testing a second pump. This capability is provided by including an additional set of the aforedescribed elements of the flow testing structure 14. This may include one, but preferably all, of the following elements: an additional conduit 16' for receiving the fluid flow to be tested, an additional valve 18' for controlling flow volume, an additional restricting means for restricting flow according to a corresponding nozzle size, an additional pitot tube assembly, an additional first chamber defined by an additional first housing 32', an additional redirecting means, additional dividing and diverting means, and additional fluid dispersing structure 74'. In one embodiment, the additional fluid dispersing structure 74' is located in same second chamber 56 that is common to the primary pump testing apparatus. The additional elements may be mounted on the second housing 66 in a manner similar to the elements of the primary flow testing structure. Preferably, the elements of the additional testing structure are oriented in a substantially opposite orientation on the second housing 66 such that the fire hose connections can be made at opposite ends of the second housing to help balance out the forces applied to the apparatus 10 by the fluid flows in opposite directions. This permits the fluid flow to leave the respective first chambers and enter the common second chamber at substantially opposite ends of the second housing 66. This relationship facilitates a more even distribution of the fluid flow entering the second chamber.

In one embodiment of the system, a baffle wall 80 is located in the interior of the second chamber 56 for guiding fluid flow in the interior of the second chamber in a convoluted manner. Preferably, the baffle wall 80 forces the fluid flow to make a change of direction in the second chamber of approximately 180 degrees. The baffle wall 80 may substantially divide the second chamber into the first 62 and second 64 portions. Illustratively, the baffle wall 80 may extend substantially parallel to an initial portion of the fluid flow in the second chamber 56.

The baffle wall 80 may include a flow opening 82 for permitting the fluid flow to move from the first portion 62 to the second portion 64 of the second chamber 56. The flow opening 82 may be located remotely from a location where the fluid flow enters the second chamber 56 from the first chamber 30, and the flow opening may be located toward a bottom of the baffle wall 82. Preferably, a plurality of the flow openings 82 is located in the baffle wall, and optionally the flow openings may be semicircular in shape. Optionally, a shield 86 may be positioned adjacent to the flow opening 82 that is located closest to the fluid dispersing structure 74 so that fluid flowing through the fluid dispersing structure is prevented from flowing directly through the flow opening. The shield 86 requires a more contorted path for the fluid flow, and may comprise an upper shield portion 88 with a semicircular cross section, and an end wall portion 90 that supports an end of the upper shield portion 88. An end of the upper shield portion 88 located opposite of the end wall portion 90 may be mounted on the baffle wall 80. Optionally, the upper shield portion 88 may be perforated.

The baffle wall 80 may also include a vent opening 84 for permitting air to move between the first 62 and second 64 portions of the second chamber 56, which can minimize the collection of fluid in the first portion due to suction developing in the first portion caused by the rapid and massive fluid movement through the first portion. The vent opening may be located adjacent to a location where the fluid flow enters the second chamber 56, and may be located adjacent to a top of the baffle wall 80. Preferably, a plurality of the vent openings 84 is located in the baffle wall 80 at substantially uniformly separated locations along the baffle wall.

In the illustrative embodiment of the invention, the baffle wall 80 extends from the upper wall 68 of the second housing 66 toward the lower wall 70 of the second housing, and extends in a substantially perpendicular orientation to the upper wall.

The discharge opening 60 of the second chamber 56 is preferably significantly larger than the intake of the conduit 16 of the flow testing structure 14 so that the velocity of the fluid flow is significantly decreased as the fluid moves through the apparatus 10. The configuration of the size and shape of the discharge opening 60 preferably should be such that, at the maximum fluid flow volume through the second chamber, the fluid flow does not completely occupy the discharge opening and thus does not present any significant resistance to movement of the fluid through the discharge opening that may increase back pressure on the fluid flow and thus increase the velocity through the discharge opening. This relationship also permits air movement into the second portion 64 of the second chamber 56 and through the vent opening 84 into the first portion 62. In one embodiment of the invention, the area of the discharge opening is at least approximately fifteen times the area of the lumen of the conduit of the flow testing structure, but the ratio may range between approximately ten to twenty times greater.

The discharge opening 60 may have a horizontal extent and a vertical extent, and in one embodiment of the invention the dimension of the horizontal extent is significantly greater the dimension of the vertical extent. Illustratively, the measurement of the horizontal extent is at least approximately nine times the measurement of the vertical extent, but the ratio may range between approximately seven to twelve times greater.

The discharge opening 60 may be elevated above the ground surface when the second housing 66 is positioned on the ground surface such that fluid may be discharged at a vertical level above an upper edge of a side wall of the reservoir 2 when the second housing is positioned adjacent to the reservoir. Preferably, the discharge opening 66 is positionable just above the upper edge of the side wall 4 of the reservoir 2 so that the vertical drop of the fluid flow into the reservoir is minimized and is less likely to produce air bubbles in the fluid in the reservoir.

In utilization of the present invention to test the output characteristics of one or two pumps on a piece of fire fighting equipment, the reservoir may be filled with a fluid such as water. Illustratively, a reservoir having a capacity of approximately 2500 gallons may be filled with a quantity of water of approximately 1800 gallons and effectively utilized for testing one or two pumps. Significantly, this quantity of water may be carried to the testing site by tanks in the fire fighting equipment, and after the pump testing has been conducted, the water may be returned to the fire fighting equipment with relatively minimal waste.

The pump testing apparatus 10 of the invention may be moved relatively easily to the testing site, as the apparatus is relatively lightweight. In the illustrative embodiment fabricated primarily out of aluminum, the apparatus weighs approximately 200 to 250 pounds, and various elements or portions of the invention may be removed or disassembled for facilitating transport. The apparatus 10 may be positioned adjacent to the reservoir on the ground with the discharge opening positioned above the side wall portion 4 of the reservoir so that water falling from the discharge opening will fall into the reservoir.

The intake conduit 6 may be positioned with its intake opening located approximately 8 to 10 feet away from the discharge opening of the pump testing apparatus. This distance may be less when lower flow rates are being used. The output fire hose 8 may be connected to the output of the pump 1 to be tested and may also be connected to the coupler 12 of the pump testing apparatus 10. For testing two pumps simultaneously and independently, an output hose 8 from each of the pumps to be tested may be connected to one of the primary and additional pump testing structures. Operation of the pumps may be conducted simultaneously, with flow characteristics recorded for each of the pumps being tested. Significantly, the testing of the flow characteristics is conducted on the fluid flow prior to the fluid flows of the pumps being joined together.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pump testing apparatus for testing output characteristics of a fluid flow exiting a pump, comprising:

a flow testing structure for testing characteristics of the fluid flow;

a first chamber having an interior for receiving a fluid flow exiting the flow testing structure;

a second chamber having an interior for receiving fluid flow from the first chamber, the second chamber having an entrance opening for receiving fluid flow into the interior of the second chamber and a discharge opening for discharging fluid flow from the interior of the second chamber, the second chamber defining a convoluted path for the fluid flow between the entrance opening and the discharge opening; and means located in at least one of the first chamber and the second chamber for reducing a velocity of the fluid flow.

2. The apparatus of claim 1 wherein the means for reducing the velocity of the fluid flow is located in both of the first and second chambers.

3. The apparatus of claim 1 wherein the first chamber is substantially sealed against movement of air from an exterior of the first chamber to the interior of the chamber for resisting air infiltration into the fluid flow.

4. The apparatus of claim 1 wherein the means for reducing the velocity of the fluid flow is located in both of the first and second chambers;

wherein the means for reducing the velocity of the fluid flow includes redirecting means located in the first chamber for redirecting the fluid flow in the interior of the first chamber;

wherein the redirecting means turns the fluid flow at least 90 degrees between a direction of initial fluid flow and a direction of redirected fluid flow;

wherein the redirecting means comprises a redirecting conduit having an entrance in the interior of the first chamber and having an exit located outside of the first chamber in the interior of the second chamber;

wherein the means for reducing the velocity of the fluid flow includes dividing means for dividing the fluid flow in the first chamber into at least two substantially separate fluid flows;

wherein the means for reducing the velocity of the fluid flow includes diverting means for diverting the at least two separate fluid flows away from each other in generally opposite directions;

wherein the second chamber comprises two portions, a first portion of the second chamber being in communication with the entrance opening for initially receiving the fluid flow entering the second chamber and a second portion of the second chamber being in communication with the discharge opening for receiving the fluid flow from the first portion and discharging the fluid flow through the discharge opening;

wherein the first and second portions of the second chamber define a convoluted path for the fluid flow with at least one approximately 180 degree change of direction for the path of the fluid flow in the second chamber;

wherein the convoluted path through the second chamber additionally includes at least one 90 degree change of direction for the fluid flow as the fluid exits through the discharge opening;

wherein a second housing defines the second chamber, the second housing being positioned below a first housing defining the first housing for receiving fluid flow from the first chamber;

wherein the means for reducing the velocity of the fluid flow includes a fluid dispersing structure positioned in the second chamber for receiving the fluid flow entering the second chamber and dispersing the fluid flow in the second chamber, the fluid dispersing structure having an inverted substantially conical shape, the fluid dispersing structure has a substantially conical wall with a plurality of perforations formed therein;

at least one baffle wall located in the interior of the second chamber for guiding fluid flow in the interior of the second chamber, the baffle wall substantially dividing the second chamber into the first and second portions;

wherein the baffle wall has a flow opening for permitting the fluid flow to move from the first portion to the second portion of the second chamber and a vent opening for permitting air to move between the first and second portions of the second chamber; and wherein the first chamber is substantially sealed against movement of air from an exterior of the first chamber to the interior of the chamber for resisting air infiltration into the fluid flow.

5. The apparatus of claim 1 wherein the means for reducing the velocity of the fluid flow includes redirecting means located in the first chamber for redirecting the fluid flow in the interior of the first chamber.

6. The apparatus of claim 5 wherein the redirecting means turns the fluid flow at least 90 degrees between a direction of initial fluid flow and a direction of redirected fluid flow.

7. The apparatus of claim 5 wherein the redirecting means comprises a redirecting conduit having an entrance in the interior of the first chamber and having an exit located outside of the first chamber in the interior of the second chamber.

8. The apparatus of claim 1 wherein the means for reducing the velocity of the fluid flow includes dividing means for dividing the fluid flow in the first chamber into at least two substantially separate fluid flows.

9. The apparatus of claim 8 wherein the means for reducing the velocity of the fluid flow includes diverting means for diverting the at least two separate fluid flows away from each other in generally opposite directions.

10. The apparatus of claim 1 wherein the second chamber comprises two portions, a first portion of the second chamber being in communication with the entrance opening for initially receiving the fluid flow entering the second chamber and a second portion of the second chamber being in communication with the discharge opening for receiving the fluid flow from the first portion and discharging the fluid flow through the discharge opening.

11. The apparatus of claim 10 wherein the first and second portions of the second chamber define a convoluted path for the fluid flow with at least one approximately 180 degree change of direction for the path of the fluid flow in the second chamber.

12. The apparatus of claim 11 wherein the convoluted path through the second chamber additionally includes at least one 90 degree change of direction for the fluid flow as the fluid exits through the discharge opening.

13. The apparatus of claim 1 wherein a second housing defines the second chamber, the second housing being positioned below a first housing defining the first housing for receiving fluid flow from the first chamber.

14. The apparatus of claim 1 wherein the means for reducing the velocity of the fluid flow includes a fluid dispersing structure positioned in the second chamber for receiving the fluid flow entering the second chamber and dispersing the fluid flow in the second chamber.

15. The apparatus of claim 14 wherein the fluid dispersing structure has an inverted substantially conical shape.

16. The apparatus of claim 14 wherein the fluid dispersing structure has a substantially conical wall with a plurality of perforations formed therein.

17. The apparatus of claim 1 additionally comprising at least one baffle wall located in the interior of the second chamber for guiding fluid flow in the interior of the second chamber, the baffle wall substantially dividing the second chamber into first and second portions.

18. The apparatus of claim 17 wherein the baffle wall has a flow opening for permitting the fluid flow to move from the first portion to the second portion of the second chamber and a vent opening for permitting air to move between the first and second portions of the second chamber.

19. A system for testing output characteristics of a fluid flow exiting a pump, comprising:

a reservoir for holding a quantity of fluid; and a pump testing apparatus positioned adjacent to the reservoir, comprising:

a flow testing structure for testing characteristics of the fluid flow;

a first chamber having an interior for receiving a fluid flow exiting the flow testing structure;

a second chamber having an interior for receiving fluid flow from the first chamber, the second chamber having an entrance opening for receiving fluid flow into the interior of the second chamber and a discharge opening for discharging fluid flow from the interior of the second chamber, the second chamber defining a convoluted path for the fluid flow between the entrance opening and the discharge opening, the discharge opening being located above the reservoir; and means located in at least one of the first chamber and the second chamber for reducing a velocity of the fluid flow.

* * * * *